US005701626A

United States Patent [19]

Zara et al.

[11] Patent Number: 5,701,626

[45] Date of Patent: Dec. 30, 1997

[54] BRUSH CLEANING AND DISINFECTING DEVICE

[76] Inventors: Sebastian Zara, 22 Susan Dr., Marlboro, N.J. 07746; Anthony Barreca, 2019 W. 9th St., Brooklyn, N.Y. 11223

[21] Appl. No.: 672,434

[22] Filed: Jun. 28, 1996

[51] Int. Cl.[6] ..... A46B 17/06

[52] U.S. Cl. ..... 15/38; 15/65; 15/76

[58] Field of Search ..... 15/38, 65–67, 15/70, 75, 76

[56] References Cited

U.S. PATENT DOCUMENTS

| | | | |
|---|---|---|---|
| 2,907,059 | 10/1959 | Cornett | 15/65 |
| 3,036,320 | 5/1962 | Behrendt | 15/65 |
| 3,058,134 | 10/1962 | Wozniak-Rennek | 15/38 |
| 3,080,591 | 3/1963 | Townsend | 15/38 |
| 3,913,163 | 10/1975 | Durham | 15/75 |

*Primary Examiner*—David Scherbel
*Assistant Examiner*—Terrence Till
*Attorney, Agent, or Firm*—Goldstein & Associates

[57] ABSTRACT

A brush cleaning and disinfecting device, for cleaning a brush having brush bristles, comprising a housing having an upper portion and a lower portion. The lower portion having a cavity capable of retaining a fluid disinfecting solution. The upper portion having a top having an aperature for inserting the brush to be cleaned into the cavity. Cleaning elements are arranged circumferentially around the aperature for engaging the brush circumferentially. The cleaning elements are each mounted on a shaft extending through the top. A pulley is attached to each shaft. The pulleys are connected to each other and to a drive motor with a drive belt, for rotating the cleaning elements.

7 Claims, 3 Drawing Sheets

BRUSH CLEANING AND DISINFECTING DEVICE

BACKGROUND OF THE INVENTION

The invention relates to a brush cleaning and disinfecting device. More particularly, the invention relates to a device which cleans a brush with a plurality of brush cleaning elements, while the brush is submerged in a disinfecting solution which simultaneously sterilizes the brush.

It has always been a problem in commercial estabishments, as it has been in private homes, to maintain in a wholesome and aseptic condition, the tools used for grooming the hair. It is well known that hair contains a certain amount of natural body oils which contaminate a brush or comb as soon as it is drawn through the hair. In addition, hair treatment and styling chemicals also tend to coat the brush bristles. Furthermore, many individuals have scalp conditions that are contagious, and it is of course desirable, and in some states mandatory by law, to disinfect a brush or comb between uses with different customers. Accordingly, it is one of the important objects of the present invention to provide a mechanized apparatus for effectively cleaning hair brushes and hair combs.

One of the problems encountered in cleaning hair brushes is that contaminating materials tend to cling to the bristles of the brush. It has been found that to effectively clean brushes and combs it is necessary to dislodge such material that has adhered to the brush or comb. Accordingly, another object of the present invention is to provide a mechanized brush or comb cleaner which utilizes a rotary brush elemet in conjunction with the disinfecting solution to effect scrubbing of the brushes and combs, to dislodge any material that has adhered thereto.

To effectively clean a hair brush, it is not enough that the material that has adhered to the bristles of the brush be dislodged and removed. Additionally, the surfaces from which the material has been removed should be disinfected to insure that the next customer will not be contaminated.

The conventional way of cleaning and disinfecting hair brushes in beauty parlors is to first remove by hand the hair that gets engtangled in the bristles, scrub the bristles intensely to remove built-up substances, and then immerse the brushes and combs in a disinfecting solution, where they are left for an indefinite period of time. The cleaning task is a time consuming arduous task, which is either performed by the beautician, or by other salon employees.

Conventionally, the cleaning operation for hair brushes and hair combs in beauty parlors is carried out in a back room, over a sink—out of sight of the customers. As a result, it is understood that customers frequently raise the question of cleanliness of the tool, and ask pointedly whether the tools have been disinfected.

Others have attempted to produce motorized brush cleaning devices, in an attempt at automating the brush cleaning task.

U.S. Pat. No. 3,982,296 to Russo, discloses a hair brush and comb cleaning apparatus. In Russo, implements to be cleaned are attached onto a central mast in an autoclave-like housing, which is then sealed prior to operating the device. The brushes are cleaning by a pair of cleaning members which revolve around the brushes concentric with the central mast. Disinfecting solution is sprayed on the brushes, and is drained by a plumbing hook-up. A heater dries the brushes at the end of the cleaning cycle. The apparatus described in Russo is extremely complicated, cannot be installed without a plumbing hook-up, and will not effectively scrub a brush from all sides. In particular, the portion of the brush that is adhered to the central mast will not be cleaned by the cleaning elements. Further, the entire cleaning cycle of Russo is time consuming, requiring several brushes to be collected before cleaning, for it would be wasteful of energy to perform a complete cycle to clean just one brush.

U.S. Pat. Nos. 3,217,349 to Hull et al.; 3,072,939 to Rehberg; 3,225,377 to Winter et al.; and 3,805,318 to Marquette each describe brush cleaners that do not disinfect the brushes, which are designed for cleaning flat brushes, and cannot effectively be used on a cylindrical "round" type brush.

While these units may be suitable for the particular purpose employed, or for general use, they would not be as suitable for the purposes of the present invention as disclosed hereafter.

SUMMARY OF THE INVENTION

It is a primary object of the present invention to provide a device which will substantially reduce the time and effort required to clean a large number of hair brushes. The device simultaneously cleans foreign matter from the brushes and sterilizes the brushes.

It is an object of the invention to provide such a device which will cause little or no wear to the brushes themselves, and yet will clean them sufficiently to meet health requirements.

It is yet another object of the invention to provide a device which is inexpensive to manufacture, and easy to maintain.

It is a further object of the invention to provide such a cleaning device which will collect the foreign material for easy disposal.

It is yet a further object of the invention to provide a device which allows a brush to be held in the hand while it is being cleaned, but which eliminates any danger that a person could be injured by rotating cleaning elements or other mechanical components.

It is a still further object of the invention to provide a mechanized apparatus which is attractive in appearance, and which may be mounted and used in close proximity to the work station of a beauty parlor operation, so that a customer may see that the tools used by the beautician are cleaned, disinfected and dried before use—thus increasing the confidence of the customer in the cleanliness of the shop.

The invention is a brush cleaning and disinfecting device, for cleaning a brush having brush bristles, comprising a housing having an upper portion and a lower portion. The lower portion having a cavity capable of retaining a fluid disinfecting solution. The upper portion having a top having an aperature for inserting the brush to be cleaned into the cavity. Cleaning elements are arranged circumferentially around the aperature for engaging the brush circumferentially. The cleaning elements are each mounted on a shaft extending through the top. A pulley is attached to each shaft. The pulleys are connected to each other and to a drive motor with a drive belt, for rotating the cleaning elements.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
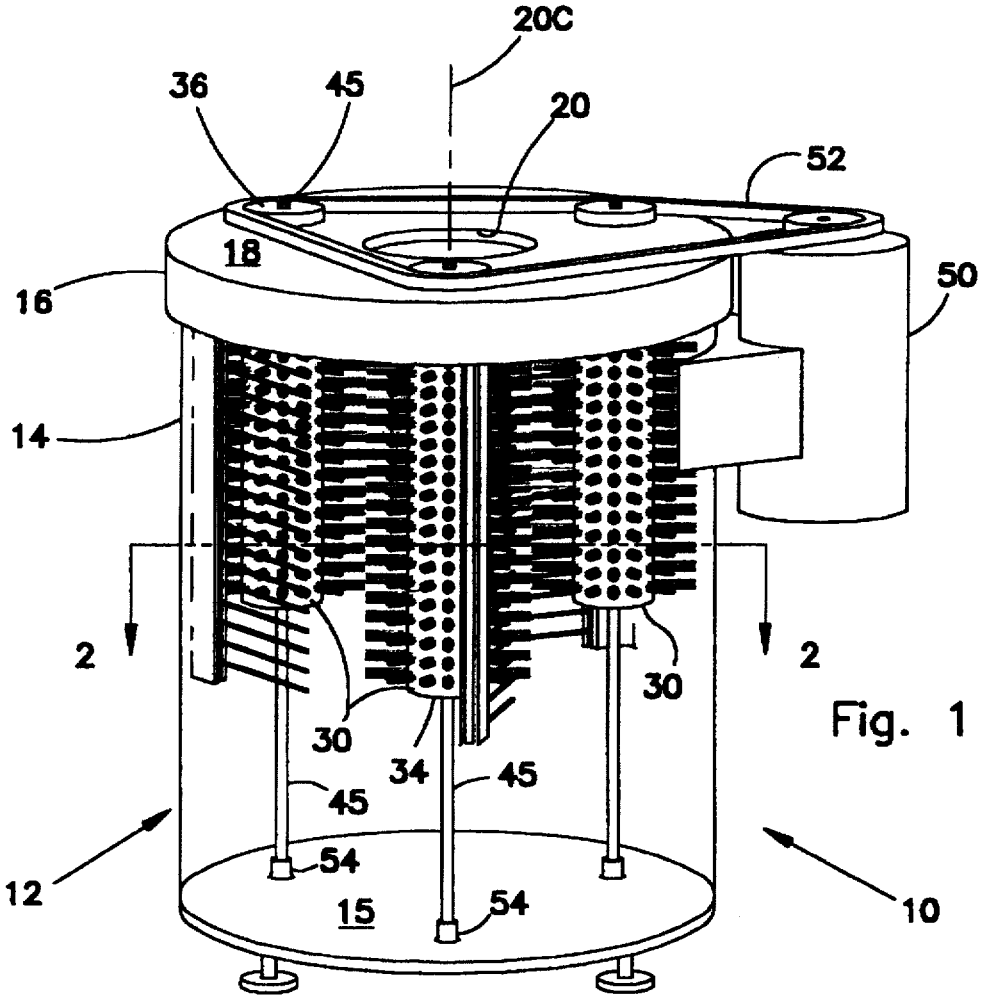
FIG. 1 is a diagrammatic perspective view of the invention fully assembled and ready for use.

FIG. 1 illustrates a brush cleaning and disinfecting device 10 having a housing 12, comprising a lower portion 14 and an upper portion 16. The lower portion 14 forming a cavity which is capable of retaining a liquid. In particular, the lower portion 14 can be made of transparent plastic, as illustrated in FIG. 1, to enable easy observation of the cleaning process. In addition, the liquid contained within the cavity would normally be a disinfectant solution, typically of a type normally used when manually disinfecting, hair brushes and combs, and hair cutting implements.

The upper portion 16 has a top 18, having an aperature 20 in its center. The aperature 20 is large enough to allow a typical hair brush to be inserted through the aperature 20 into the cavity of the lower portion 14. The aperature 20 has an aperature central axis 20C which extends vertically through the aperature 20 at its center. The aperature 20 can have a diaphram, of the type typically used at the mouth of a garbage disposal sytem. The diaphram could contain three or more flaps which will normally cover the aperature 20, but will spread apart to allow the hair brush to be inserted therethrough when sufficient downward pressure upon the diaphram is employed. The use of the diaphram will help prevent hand and finger injuries, and will prevent the evaporation of disinfecting solution and the odors associated therewith.

A brush cleaning mechanism includes a plurality of cleaning elements 30 which extend into the lower portion 14. Ideally, the brush cleaning mechanism is arranged within the cavity circumferentially around the aperature 20, so that when the brush is inserted downward through the aperature 20, the brush is engaged on all sides by the cleaning elements 30. Thus, referring to FIG. 2, three cleaning elements 30 are arranged so that the brush descended centrally into the cavity would be engaged by all three cleaning elements 30. The cleaning elements have cleaning bristles 32, and a center body 34. The cleaning bristles 32 extend radially outward from the center body 34.

Figure 2:
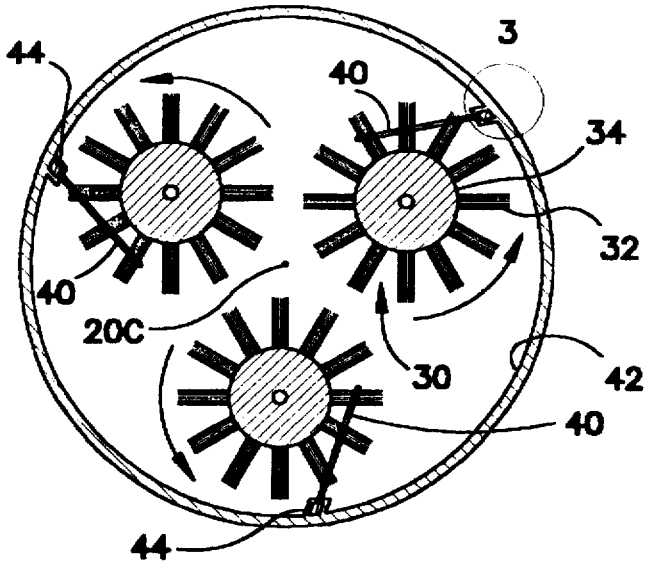
FIG. 2 is a cross sectional view, taken along line 2—2 in FIG. 1, illustrating the cleaning elements and comb members.

Also illustrated in FIG. 2, comb members 40 are arranged so that they mesh with the cleaning bristles 32, so that they will tend to dislodge any buildup of debris in the cleaning elements 30 themselves. The cavity of the lower portion is defined by an inner cavity wall 42 to which the comb members 40 are mounted. Comb sleeves 44 extend vertically on the inner cavity wall 42, and are equally spaced around the inner cavity wall 42 for accepting the comb member 40. In particular, typically three comb members 40 are employed to interact with the typical three cleaning elements 30, and thus the comb sleeves 44 are spaced 120 degrees apart on the inner cavity wall 42. The comb members 40 serve the additional purpose of preventing a "whirlpool" from developing inside the cavity as the cleaning members 30 rotate within the disinfecting solution present in the cavity.

Figure 3:
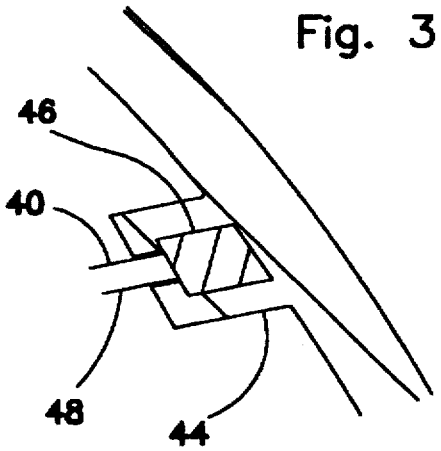
FIG. 3 is a detail of the comb members in their associated comb sleeves, taken generally in the area of circle 3 in FIG. 2.

Referring to FIG. 3, each comb has a hub 46 sized to fit into the comb sleeve 44, so that the comb members 40 can slide vertically downward into the comb sleeves 44 where they are rigidly held in place. The comb members 40 have teeth 48 which extend away from the numb 46, and thus extend away from the comb sleeve when the comb members 40 are mounted in the comb sleeves 44.

Referring back to FIG. 2, the cleaning elements 30 rotate in the direction of the curved arrows indicated around each cleaning elements 30. Thus, all cleaning elements 30 rotate in the same direction. In addition, when the cleaning elements 30 rotate, a rotating cleaning bristle circumference is formed by the cleaning bristles. The rotating cleaning bristle circumference has a trailing edge. The teeth 48 extend into the bristles, such that when the cleaning elements are rotating, the bristles sweep across the teeth 48 in the same direction that the teeth extend from the nub 46, the sleeve 44, and thus the cavity wall 42.

Figure 6:
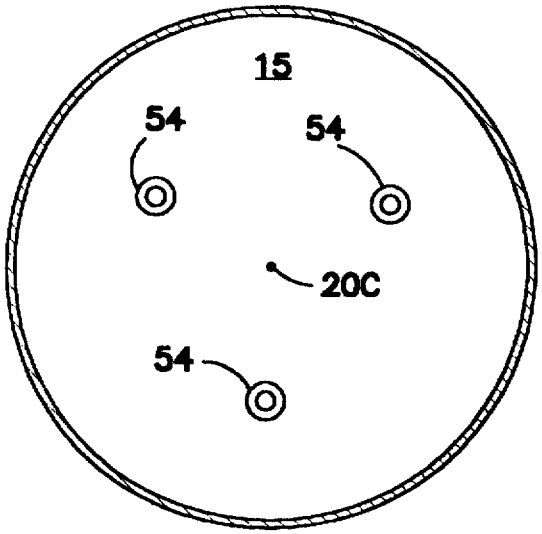
FIG. 6 is a cross sectional view, taken along line 6—6 in FIG. 5, illustrating the shafts seats in the cavity bottom.

Referring back to FIG. 1, each cleaning element 30 is mounted on a shaft 45, the shaft concentric with the central body 34 of the cleaning element 30. The shafts 45 extend through the top 18, where they are each attached to a pulley 36. A drive motor 50 connects all pulleys with a common drive belt 52. Thus, the drive belt 52 extends along the top 18, fully around the aperature 20. Each shaft 45 is held in place opposite the pulley 36 in a shaft seat 54 in a cavity bottom 15 in the lower portion 14 of the housing 12. The shaft seat 54 prevents torsion of the shaft 45 but allows it to rotate therein, and further allows the shaft 45 to be easily removable from the shaft seat 54 by simply pulling the shaft 45 upward and out of the shaft seat 54. The removability of the shaft 45 allows the cleaning elements 30 to be easily cleaned and replaced. Referring momentarily to FIG. 6, the shaft seats 54 are arranged on the cavity bottom 15 equidistant from the aperature central axis 20C.

The center body 34 of each cleaning element 30 is located a predetermined distance from the cavity bottom 15. Spacing the center body a predetermined distance from the cavity bottom 15 is intentional, since between replacements of the disinfecting solution, there will be a tendency for a buildup of sediment near the cavity bottom 15. It is desirable to have the center body and its cleaning bristles above such sediment, to avoid transferring the sediment back onto a brush being cleaned. This predetermined distance is set by empirical testing to determine the height of the sedimentary level that develops during a maximum time between replacement of the disinfecting solution.

Figure 5:
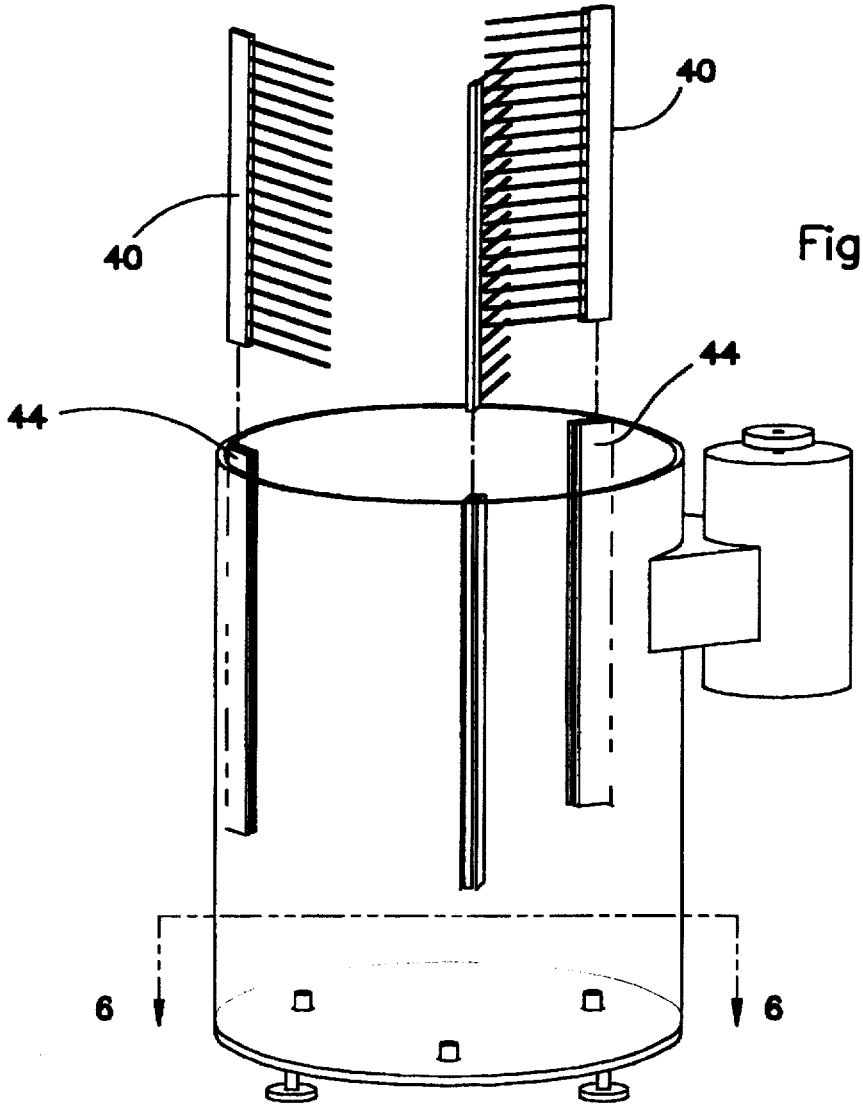
FIG. 5 is an exploded view, illustrating the insertion of the combs into the comb sleeves.

FIG. 5 is an exploded view of a portion of the brush cleaning device and disinfecting device 10, illustrating a first assembly step in which the combs 40 are inserted into the comb sleeves 44.

Figure 4:
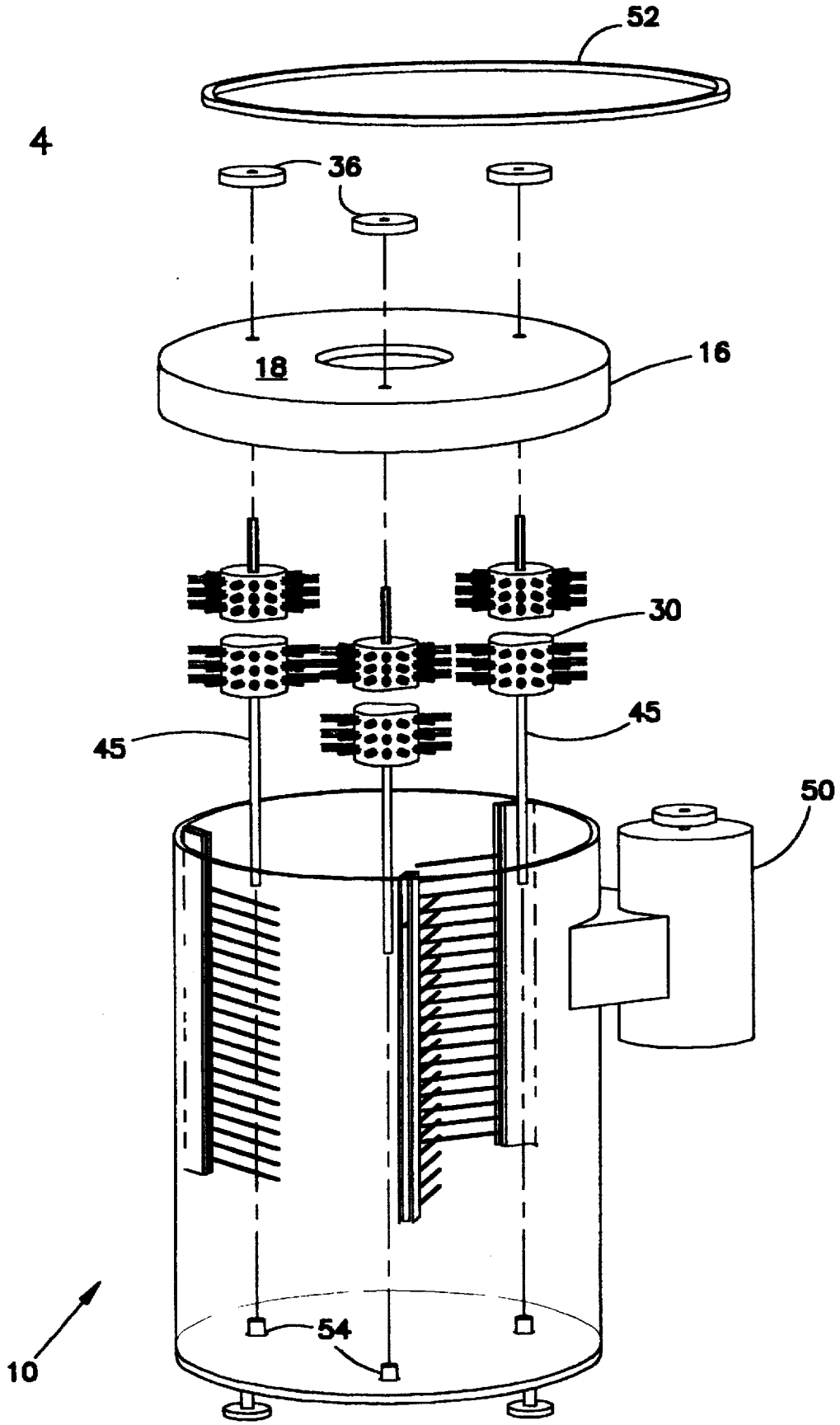
FIG. 4 is an exploded view, illustrating the various components of the invention.

FIG. 4 is an exploded view of the brush cleaning and disinfecting device 10, illustrating further assembly steps, in which the shafts 45 of the cleaning elements 30 are inserted through the top 18 of the upper housing 16, where they are each affixed to one of the pulleys 36, so that the pulleys and shafts 45 rotate together. The shafts 45 are urged into the shaft seats 54 where they are allowed to freely rotate. The pulleys 36 are connected to one another and to the drive motor 50 with the drive belt 52. Advantageously, the drive motor 50 may be affixed to the upper housing 16, so that the shafts may be lifted from the lower portion, for allowing cleaning of the cleaning elements, without removing the drive belt 52.

Referring back to FIG. 1, it is clear that in a commercial version of the brush cleaning and disinfecting device, ergonomic variations will be made to make the product safer, more easy to operate, and more aesthetically pleasing than the embodiment shown. For example, the housing will have provisions for enclosing moving parts, including the pulleys 36, drive belt 52, and drive motor 40. In addition, switches will be provided for turning the device on and off. An automatic switch might be employed to turn the device on and then off—when a brush is inserted through the aperature and is then removed from the aperature.

In addition, it is desirable to remove hair from a brush to be cleaned prior to using the brush cleaning and disinfecting device. Hair may be removed from a brush by briskly rubbing it with another brush or comb. Thus, advantageously a brush or comb suitable for removing hair from a brush to be cleaned might be mounted externally on the housing of the brush cleaning and disinfecting devicen for convenient hair removal prior to inserting the brush through the aperature.

In conclusion, herein is presented a brush cleaning and disinfecting device which allows a brush to be inserted into a central aperature, where it is engaged by a plurality of cleaning elements which scrub impurities therefrom, and where it is simultanteously submerged into a disinfecting solution for sterilization. The brush cleaning and disinfecting device is safe, convenient, and easy to use.

What is claimed is:

1. A brush cleaning and disinfecting device, for cleaning a brush having a plurality of brush bristles, comprising:

a housing, the housing comprising a lower portion and an upper portion having a top, the lower portion forming a cavity capable of retaining a liquid, the upper portion having a brush receiving aperture capable of allowing the brush to be inserted at least partially downward into the cavity;

the lower portion having a bottom, the bottom having a shaft seat for each cleaning element, each shaft seat accepting the shaft from one of the cleaning elements, allowing the shaft to rotate therein, and allowing the shaft to easily left from the shaft seat when the cleaning elements are being removed to be cleaned themselves;

a brush cleaning means extending inside the lower portion comprising a drive motor which causes the cleaning elements to rotate in the same direction when the brush is inserted into the lower portion, the brush cleaning means including at least three cleaning elements, each cleaning element having a shaft which extends into the upper portion and each shaft having a pulley connected to the drive motor with a common drive belt, arranged circumferentially around an aperture central axis, for engaging the brush circumferentially; and at least one comb member present in the lower portion, the comb member meshing with at least one of the cleaning elements.

2. The brush cleaning and disinfecting device as recited in claim 1, wherein the cleaning elements have a central body which is concentric with the shaft, and cleaning bristles which extend radially from the cleaning elements.

3. The brush cleaning and disinfecting device as recited in claim 2, wherein there is a comb member associated with each cleaning element.

4. The brush cleaning and disinfecting device as recited in claim 3, wherein the comb member has teeth, the teeth extending substantially tangentially to a rotating cleaning bristle circumference formed by the cleaning bristles as the cleaning element rotates.

5. The brush cleaning and disinfecting device as recited in claim 4, wherein the teeth extend midway across a trailing edge of a rotating cleaning bristle circumference.

6. The brush cleaning and disinfecting device as recited in claim 5, wherein the lower portion comprises an inner cavity wall, further having a comb sleeve for each of the combs mounted on the inner cavity wall, the comb sleeves extending vertically on the inner cavity wall, the combs capable of sliding vertically downward into the comb sleeves, the teeth of the combs extend away from the comb sleeves and into the cavity.

7. The brush cleaning and disinfecting device as recited in claim 6, wherein three cleaning elements are mounted substantially 120 degrees apart circumferentially around the aperture, and wherein three comb sleeves are located substantially 120 degrees apart around the inner cavity wall.

* * * * *